United States Patent [19]

Fecher

[11] 3,977,622

[45] Aug. 31, 1976

[54] REELING SPOOL

[75] Inventor: Walter Fecher, Grunstadt, Germany

[73] Assignee: Drahtwarenfabrik Drahtzug Stein KG, Drahtzug near Grunstadt, Germany

[22] Filed: Oct. 3, 1975

[21] Appl. No.: 619,452

[30] Foreign Application Priority Data

Jan. 29, 1975 Germany ..... 2503567
Mar. 21, 1975 Germany ..... 2512535

[52] U.S. Cl. ..... 242/77.2
[51] Int. Cl.[2] ..... B65H 75/20
[58] Field of Search ..... 242/77.2, 77, 115, 118.8, 242/129

[56] References Cited

UNITED STATES PATENTS

| | | | |
|---|---|---|---|
| 1,291,333 | 1/1919 | Wirt | 242/77.2 |
| 1,540,836 | 6/1925 | Hedderich | 242/77.2 |
| 1,844,494 | 2/1932 | Anderson | 242/77.2 |
| 3,503,569 | 3/1970 | Gildart | 242/77.2 |

*Primary Examiner*—Edward J. McCarthy
*Attorney, Agent, or Firm*—Kurt Kelman

[57] ABSTRACT

A spool for reeling a wire or cord is composed of a series of like adjoining and interconnected hoop portion members, each consisting of two parallel arcuate wire parts and an U-shaped wire part connecting the arcuate wire parts at one end thereof. The U-shaped parts of the interconnected hoop portion members extend radially inwardly to form a reeling hub, and the adjoining and interconnected arcuate wire parts form two parallel wire rings wherebetween the wire or cord may be reeled. This reeling hub may be placed on a mandrel of a reeling apparatus.

8 Claims, 8 Drawing Figures

REELING SPOOL

The present invention relates to a spool for reeling such elongated flexible elements as wires, particularly welding wires, or cords of metal, synthetic resin or natural fibers.

In reeling such elongated flexible elements, care must be taken that the reeling spool enables the elements to be helically reeled so that, when the spool is later inserted in a machine, they may be unwound and paid out without entanglement. This is of particular importance in storing welding wires on a spool since such wires may easily tear when they are used in a welding machine unless they have been properly reeled.

Spools of this type have conventionally been molded or stamped from synthetic resin blanks for mounting on a rotary axle or drum for reeling a wire or cord to be stored thereon. These synthetic resin spools have the disadvantage that manufacturing tolerances cause eccentric reeling so that proper helical positioning of the reeled wire or cord requires unusual care. In addition, such spools break readily. Furthermore, synthetic resin articles are environmentally disadvantageous because they are not biodegradable.

It has, therefore, been proposed to use spools composed of wire parts, the wire parts being so shaped as to form a central hub placeable on a mandrel of a reeling apparatus. The known wire spools require complex shaping of the metal wire parts and a great number of connecting welding spots to interconnect the parts to form a spool.

It is the primary object of this invention to overcome this disadvantage of wire spools and to provide spools composed of like pre-fabricated members which are interconnected.

The above and other objects are accomplished in accordance with the invention in a spool composed of a series of like adjoining and interconnected hoop portion members. Each member consists essentially of two parallel arcuate wire parts and a substantially U-shaped wire part connecting the arcuate wire parts at one end thereof, the other end being free. The U-shaped parts of the interconnected hoop portion members have two parallel legs extending radially inwardly and in the same plane as the arcuate wire parts to form a reeling hub adapted to be placed on a mandrel of a reeling apparatus. The adjoining and interconnected arcuate wire parts form two parallel wire rings wherebetween an elongated flexible element may be reeled.

Each hoop portion member may be shaped from a wire in a single step to form the U-shaped part with the arcuate parts extending from the parallel legs of the U-shaped part. Two or more like members may then be interconnected by affixing the free ends of the arcuate parts to the legs of the U-shaped part of the adjoining member, for instance by welding or other bonding. In this manner, a suitable number of such pre-fabricated hoop portion members may be joined to form a spool wherein the adjoining arcuate wire parts from two parallel rings, the length of the arcuate parts determining the number of members necessary to form a spool. The reeling hub formed by the bottom of the U-shaped parts and the two parallel side faces defined by the legs of the U-shaped parts and the arcuate parts assures proper helical reeling of wires and cords on the hub.

The manufacture of such spools is very cheap and simple. The complete spools may be transported in a minimum of space. Finally, metal wire bodies may be disposed of without harm to the environment.

The above and other objects, advantages and features of the present invention will become more apparent from the following detailed description of certain now preferred embodiments thereof, taken in conjunction with the accompanying schematic drawing wherein FIG. 1 is a side elevational view of one embodiment of a hoop portion member according to this invention;

Figure 2:
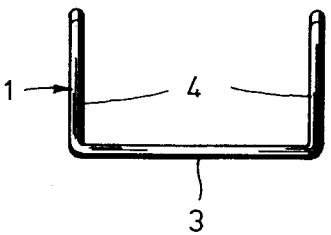
FIG. 2 is a front elevational view of FIG. 1.
Figure 1:
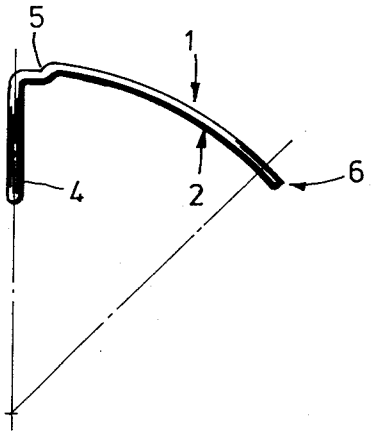
Figure 3:
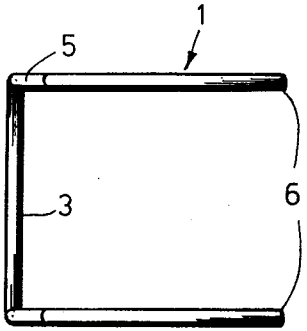
FIG. 3 is a plan view of FIG. 1.
Figure 4:
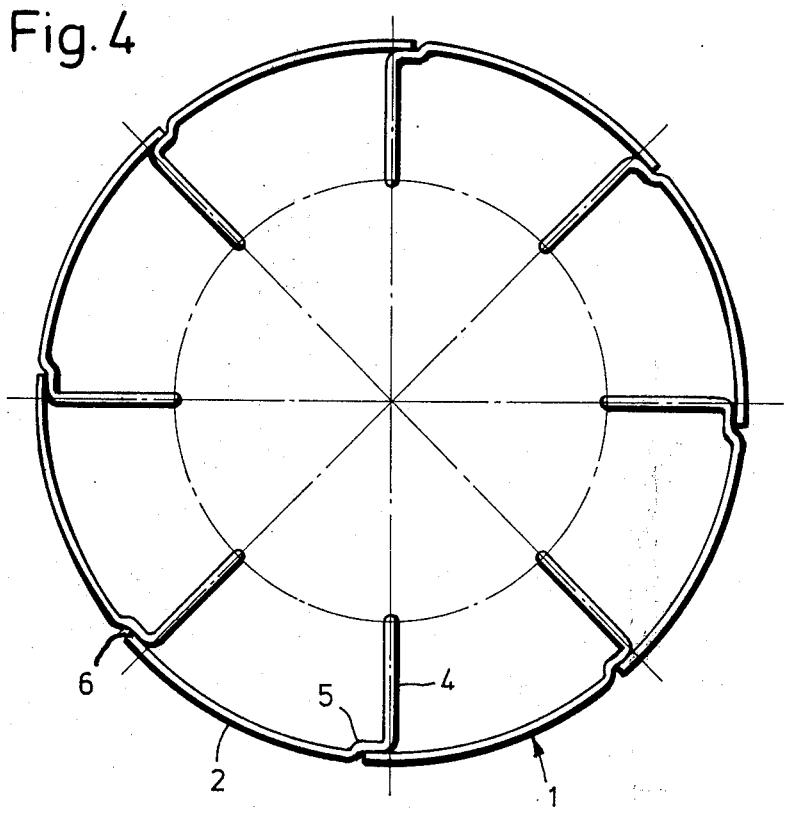
FIG. 4 is a side elevational view of a spool composed of eight hoop portions according to FIG. 1.
Figure 5:
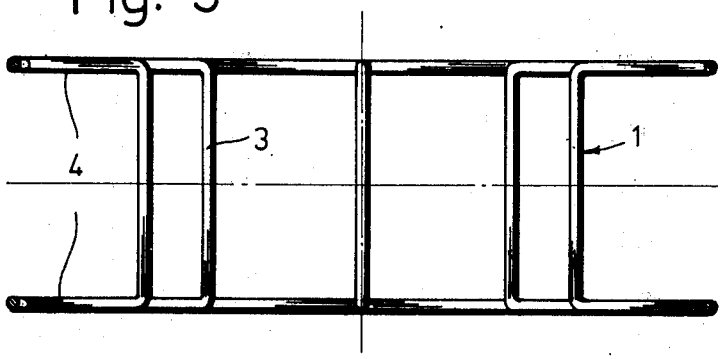
FIG. 5 is a plan view of FIG. 4.

Referring now to the drawing and first to FIGS. 1 to 5, hoop portion member 1 is shown to consist of two parallel arcuate wire parts 2, 2 and a substantially U-shaped wire part connecting the arcuate wire parts at one end thereof, the other end 6 being free. The U-shaped wire part has two parallel legs 4, 4 extending radially inwardly to form the reeling hub shown in FIG. 4. This hub may be placed on a mandrel of a reeling apparatus, such as indicated by the chain-dotted circular line in FIG. 4, with the bottoms 3 of the U-shaped parts engaging the mandrel. As shown in FIG. 5, the adjoining and interconnected arcuate wire parts 2 form two parallel wire rings wherebetween wire, cords and like elongated flexible elements may be reeled, legs 4 forming the annular side walls of the hub and bottoms 3 the inner diameter thereof.

The one ends of arcuate wire parts 1 whereto the U-shaped wire part is connected form shoulder 5 for receiving free ends 6 of the arcuate wire parts of the adjoining hoop portion members for interconnecting the hoop portion members in a manner best shown in FIG. 4. This provides a smooth circular periphery without interfering projections during winding or unwinding.

It will be readily apparent that the individual hoop portion members may be shaped from a wire in a single step, that they may be readily assembled into a spool and that the number of individual spool members required will depend solely on the length of the arcuate parts of the members.

Figure 6:
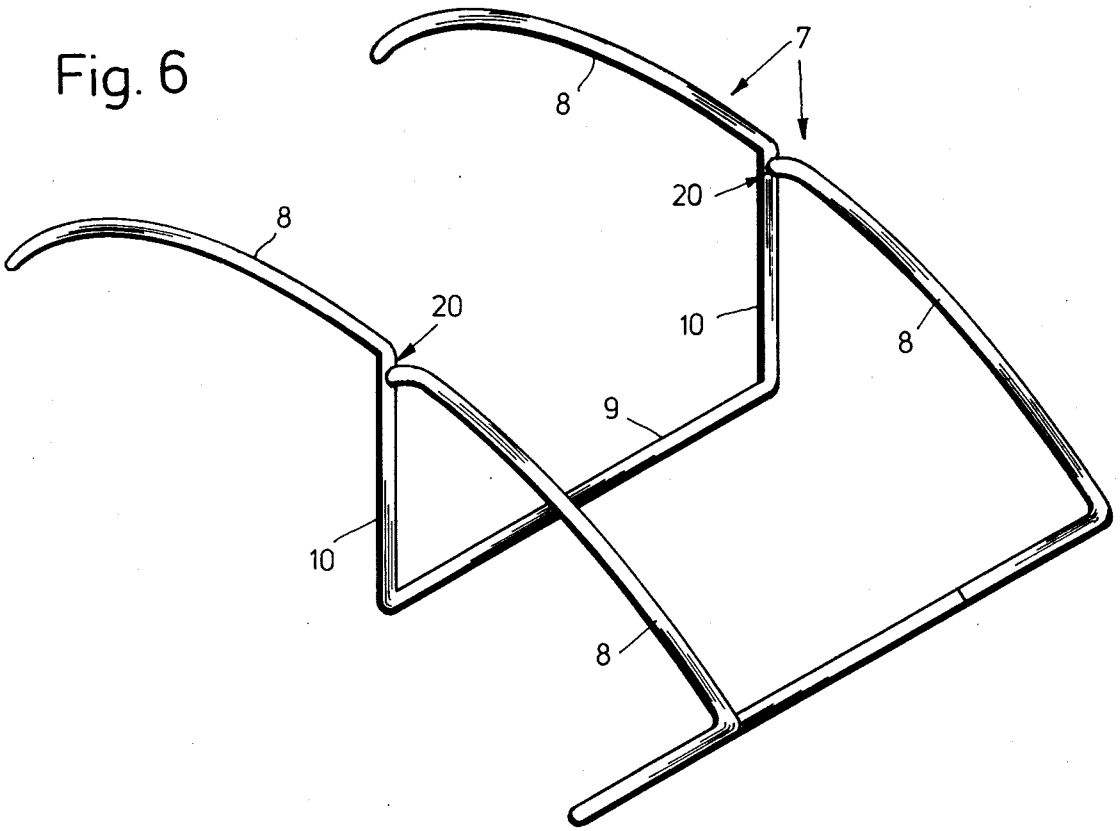
FIG. 6 is a perspective view showing two adjoining hoop portion members according to another embodiment of the invention.

The hoop portion members 7 of FIG. 6 quite similarly consist of two parallel arcuate wire parts 8, 8 and a substantially U-shaped wire part integral therewith and connecting the arcuate wire parts at one end thereof. The U-shaped wire part has two parallel legs 10, 10 interconnected by bottom 9. The free ends of the arcuate wire parts form an obtuse angle with the legs of the adjoining hoop portion member and are affixed thereto, preferably by spot welds 20.

Figure 7:
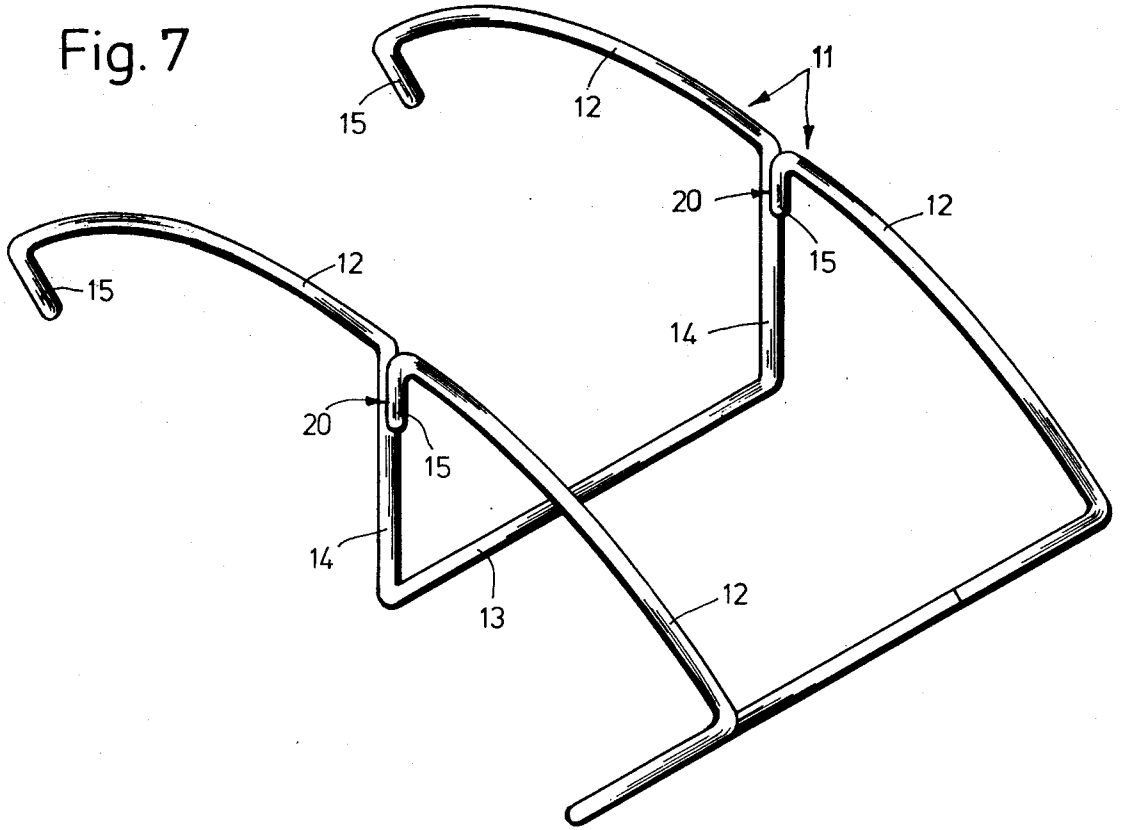
FIGS. 7 and 8 are views similar to that of FIG. 6 of two further embodiments.

In the similar embodiment shown in FIG. 7, the hoop portion members 11, 11 again consist of two parallel arcuate wire parts 12, 12 and an U-shaped wire part integral therewith and having two parallel legs 14, 14 interconnected by bottom 13. In this embodiment, however, the free ends 15, 15 of the arcuate wire parts are radially inwardly bent to extend parallel to the radially extending legs of the adjoining hoop portion member, the inwardly bent ends being again affixed to the legs by spot welds 20.

Figure 8:
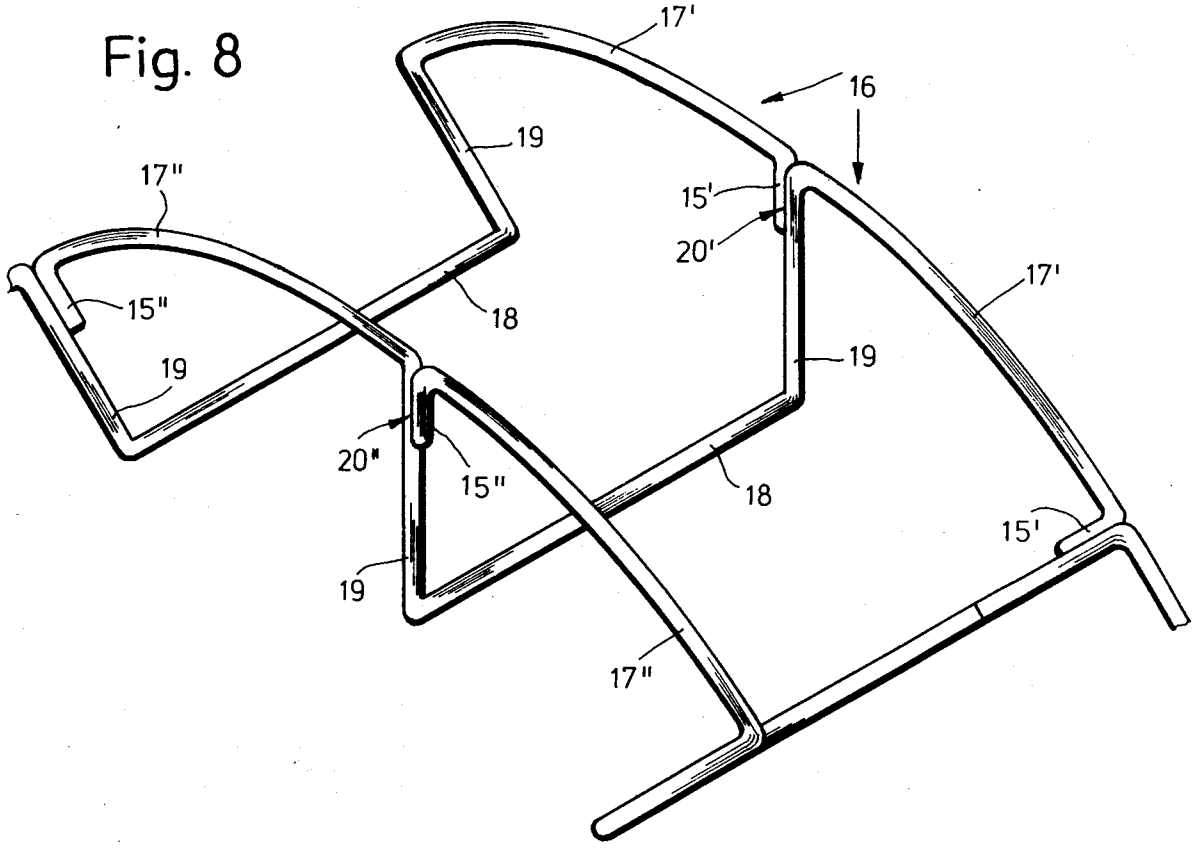

In contrast to the embodiments of the present invention described hereinabove, wherein the arcuate wire parts of the hoop portion members extend from the U-shaped part in the same direction, FIG. 8 illustrates an embodiment wherein two parallel arcuate wire parts 17', 17'' extend in opposite directions from the U-shaped wire part integral therewith and having two parallel legs 19, 19 interconnected by bottom 18. As in all embodiments, each leg 19 and adjoining arcuate part defines a plane perpendicular to bottom 18. As in FIG. 7, free ends 15', 15'' of arcuate wire parts 17', 17'' are radially inwardly bent to extend parallel to the radially extending legs of the adjoining hoop portion member and these ends are again affixed to the legs by spot welds 20', 20''.

What is claimed is:

1. A spool for reeling an elongated flexible element, composed of a series of like adjoining and interconnected hoop portion members, each member consisting essentially of two parallel arcuate wire parts and a substantially U-shaped wire part connecting the arcuate wire parts at one end thereof, the other end being free, the U-shaped parts of the interconnected hoop portion members having two parallel legs extending radially inwardly to form a reeling hub adapted to be placed on a mandrel of a reeling apparatus, and the adjoining and interconnected arcuate wire parts forming two parallel wire rings wherebetween the elongated flexible element may be reeled.

2. The reeling spool of claim 1, wherein the one ends of the arcuate wire parts whereto the U-shaped wire part is connected form shoulders for receiving the free other ends of the arcuate wire parts of the adjoining hoop portion member for interconnecting the hoop portion members.

3. The reeling spool of claim 1, wherein the free other ends of the arcuate wire parts form an obtuse angle with the radially extending legs of the U-shaped part of the adjoining hoop portion member and are affixed thereto.

4. The reeling spool of claim 3, wherein the free other ends are welded to the radially extending legs.

5. The reeling spool of claim 1, wherein the free other ends of the arcuate wire parts are radially inwardly bent to extend parallel to the radially extending legs of the U-shaped part of the adjoining hoop portion member and are affixed thereto.

6. The reeling spool of claim 5, wherein the free other ends are welded to the radially extending legs.

7. The reeling spool of claim 1, wherein the two parallel arcuate wire parts extend in opposite directions from the U-shaped wire part, the free other ends of the arcuate wire parts being radially inwardly bent to extend parallel to the radially extending legs of the U-shaped parts of the adjoining hoop portion members and being affixed thereto.

8. The reeling spool of claim 7, wherein the free other ends are welded to the radially extending legs.

* * * * *